US007437786B2

(12) United States Patent
Bellingroth

(10) Patent No.: US 7,437,786 B2
(45) Date of Patent: Oct. 21, 2008

(54) LIFT BED

(75) Inventor: Klaus Bellingroth, Gummersbach (DE)

(73) Assignee: Okin Gesellschaft fur Antriebstechnik mbH, Gummersbach (DE)

( * ) Notice: Subject to any disclaimer, the term of this patent is extended or adjusted under 35 U.S.C. 154(b) by 182 days.

(21) Appl. No.: 11/420,105

(22) Filed: May 24, 2006

(65) Prior Publication Data

US 2006/0265805 A1 Nov. 30, 2006

(30) Foreign Application Priority Data

May 24, 2005 (DE) ..... 20 2005 008 326 U

(51) Int. Cl.
*A61G 7/012* (2006.01)

(52) U.S. Cl. ..... 5/611; 5/11

(58) Field of Classification Search ..... 5/11, 5/611, 509.1

See application file for complete search history.

(56) References Cited

U.S. PATENT DOCUMENTS

| | | | | |
|---|---|---|---|---|
| 1,378,096 | A | 5/1921 | Chat | |
| 3,015,113 | A * | 1/1962 | Wallen | 5/11 |
| 3,628,200 | A * | 12/1971 | Helton | 5/611 |
| 6,505,365 | B1 * | 1/2003 | Hanson et al. | 5/613 |
| 6,678,907 | B1 * | 1/2004 | Voelker et al. | 5/611 |
| 2004/0154103 | A1 | 8/2004 | Bock | |

FOREIGN PATENT DOCUMENTS

| | | |
|---|---|---|
| DE | 3540723 | 2/1987 |
| DE | 9210204 | 9/1992 |
| DE | 19530252 | 2/1997 |
| DE | 20014679 | 2/2001 |
| DE | 200300621 | 3/2003 |
| EP | 1344474 | 9/2003 |
| NL | 1013617 | 5/2001 |

OTHER PUBLICATIONS

German Search Report dated Apr. 5, 2006 received in corresponding German Patent Application Serial No. DE 20 2005 008 326.7 (4 pages).

European Search Report dated Oct. 5, 2006 received in corresponding European Patent Application Serial No. 06010361.1 (8 pages).

* cited by examiner

*Primary Examiner*—Michael Trettel
(74) *Attorney, Agent, or Firm*—Grossman Tucker Perreault & Pfleger, PLLC

(57) ABSTRACT

On a lift bed comprising four, telescopic lifting columns, which can be connected by a reclining-surface frame (8), as well as by head (2), foot (3) and side elements (4), provision is made, to permit simple assembly and dismantling of the head, foot and side elements, for the lifting columns to each display a slit (5.4), which is parallel to the axis and points towards the adjacent side element (4), and for the reclining-surface frame (8) and the side elements (4) to display corresponding anchoring elements (4.3) that can be inserted into the slits (5.4) in sliding fashion from above.

12 Claims, 2 Drawing Sheets

LIFT BED

Figures 1, 2, 3, 4, 5:
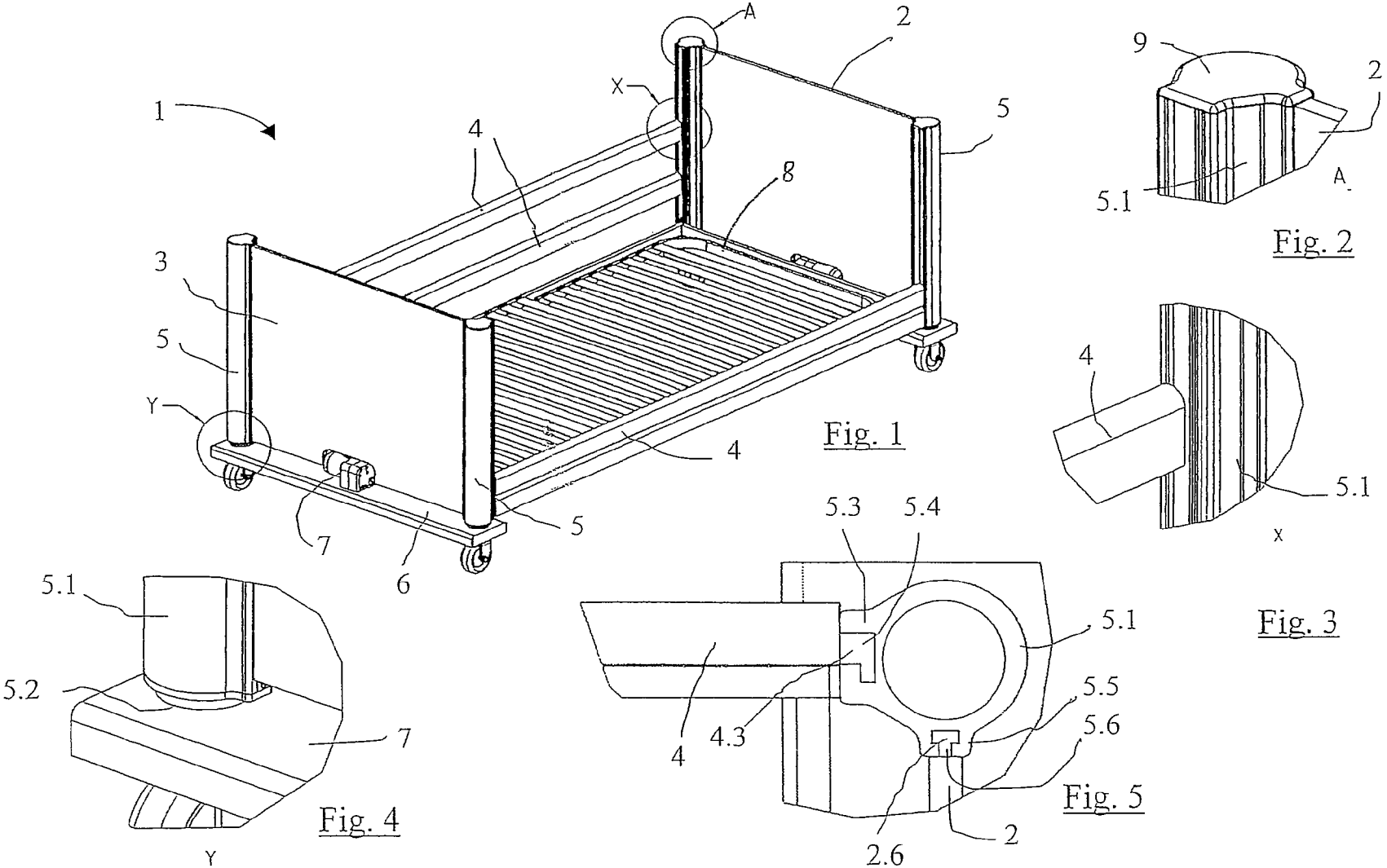

The present invention relates to a lift bed of the kind particularly used in hospitals and sick wards. Lift beds of this kind are often removed from the sick rooms and put into intermediate storage owing to changing room occupancy.

The invention further relates to a double telescopic unit as a component for use at the head or foot end of a lift bed.

On lift beds according to the prior art, the reclining-surface frame and/or the head, foot and side elements are regularly welded to the lift columns, meaning that intermediate storage requires an undesirably great amount of space.

The object of the present invention is to create a lift bed and a double telescopic unit, where the reclining-surface frame and the head, foot and side elements are easily assembled and dismantled, such that it can be stored in a very small space.

According to the invention, the lift bed comprises four, telescopic lifting columns, which can be connected by a reclining-surface frame, as well as by head, foot and side elements, where the lifting columns each display a slit, which is parallel to the axis and points towards the adjacent side element, and the reclining-surface frame and the side elements display corresponding anchoring elements that can be inserted into the slits in sliding fashion from above.

To assemble the lift bed according to the invention, the anchoring elements are inserted into the slits in sliding fashion from above. The anchoring elements of the reclining-surface frame are fixed in place in the slits of the lifting columns by suitable non-positive or positive means, such as holding or locking screws. The side elements can likewise be fixed in place in the slits at variable heights by suitable non-positive or positive securing means, such as snap-in or clamping means. The side elements then form a safety device, usually referred to as side rails, to prevent a patient lying in the bed from falling out.

The lifting columns are preferably each also provided with a slit, which is parallel to the axis and points towards the adjacent head or foot element, and the head and foot elements are provided with corresponding anchoring elements that can be inserted into the slits in sliding fashion from above.

In a preferred development of the invention, the slits display undercuts that are engaged by corresponding sections of the anchoring elements.

In a preferred embodiment of the invention, the lifting columns are designed as spindle-type telescopes, where the upper telescopic section forms an outer sleeve displaying the slit or slits.

The upper telescopic section can be designed as a continuously cast section with integrated bulbs that are parallel to the axis and accommodate the slits.

In particular, continuously-cast aluminum sections are open to consideration, where, as with sections made of other materials, the slits are integrated into the sections in one piece.

The spindle-type telescopes can be designed as two-stage or multi-stage telescopes, particularly as three-stage telescopes.

The lifting columns are formed by inherently stable spindle-type telescopes that satisfy the statical demands on the lifting columns of a lift bed and do not require any additional statical components, such as housing components.

In a preferred development of the invention, the lower, inner sleeves of the telescopic columns accommodating the head or foot element are rigidly connected via a bridge at the bottom end, i.e. in their lower area.

The two spindle-type telescopes connected by the bridge can be driven by a common electric motor, where the power is transmitted from the motor to the spindles via toothed belts, ladder chains or a shaft located within the bridge.

Insofar as the slits accommodating the side elements are not covered by the side elements, plastic covers can be provided that engage the slits, or the face end of the open section of the lifting column, in clamping or snap-in fashion.

According to the invention, two telescopic lifting columns can be used to create a double telescopic unit as a component for a lift bed, in which context the two lifting columns are rigidly connected via a bridge at the bottom end, i.e. in their lower area, and display means for attaching wheels.

The double telescopic units according to the invention form components for the head or foot end of a lift bed in the above-described embodiments. The lifting columns display a slit that is parallel to the axis and points in each case towards the adjacent side element, or additionally also towards the adjacent head or foot element, and into which the above-described anchoring elements of the reclining-surface frame, and of the head, foot and side elements, can be inserted in sliding fashion from above.

The head or foot element can be supplied inserted into the corresponding slits, or supplied attached to the two lifting columns in some other way. The component can also exist without the corresponding head or foot element.

An electric motor driving the two lifting columns can be located on or in the bridge connecting the two lifting columns to form a unit. Power transmission from the motor to the lifting columns can be accomplished via toothed belts, ladder chains or a shaft located within the bridge.

Figure 6:
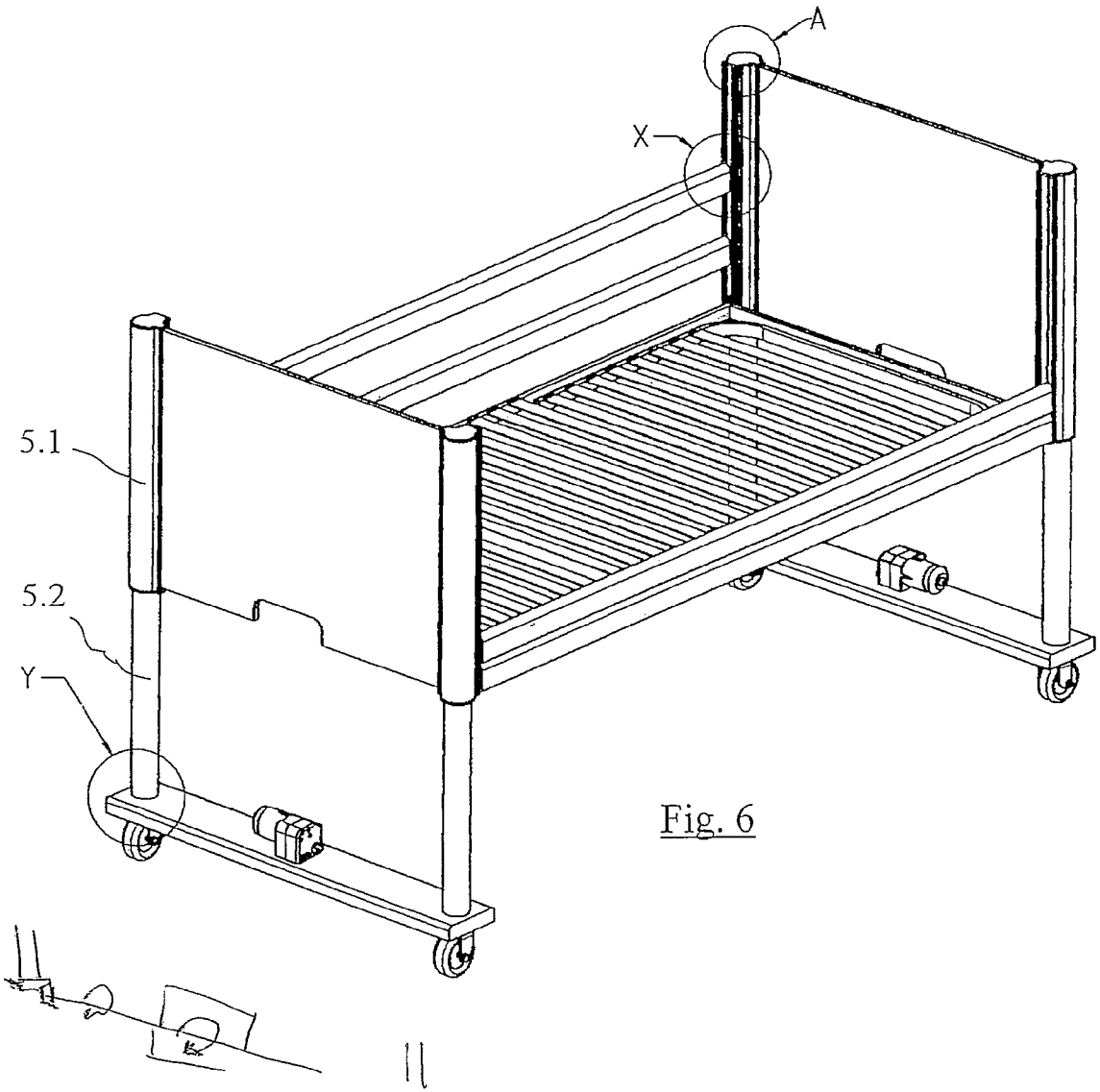

A practical example of the lift bed according to the invention is explained in more detail below on the basis of the drawings. The drawings show the following:

FIG. 1 A perspective view of the lift bed,

FIG. 2 An enlarged representation of the upper area of a lifting column, marked A in FIG. 1, FIG. 3 An enlarged representation of the area marked X in FIG. 1, FIG. 4 An enlarged representation of the area marked Y in FIG. 1, FIG. 5 A top view of a lifting column without cover, with adjacent head or foot element and side element, and FIG. 6 A perspective view of the lift bed illustrated in FIG. 1 in raised state.

FIG. 1 shows a perspective view of a lift bed 1 according to the invention. Lift bed 1 consists of a head element 2 and a foot element 3, as well as side elements 4, which can comprise several elements. The four corner posts of the bed are designed as telescopes 5, such that the bed can be moved from the low position illustrated in FIG. 1 into the high position illustrated in FIG. 6. Head element 2, foot element 3, and side elements 4 are connected to each other by outer, upper telescopic sleeves 5.1. Pairs of telescopes 5 that border an end element (head or foot element) of the bed are rigidly connected to each other via a bridge 6 at the bottom end of inner telescopic sleeves 5.2. Located on the bridge is electric drive motor 7, the axle of which reaches into the bridge. The spindles of the respective pair of telescopes 5 are driven synchronously by the common motor by means of toothed belts.

Reclining-surface frame 8 displays anchoring elements (not shown in the drawing), by means of which it is inserted into slits 5.4 and 5.6 (cf. FIG. 5) in sliding fashion from above. Slits 5.4 and 5.6 are closed at the lower end, such that reclining-surface frame 8 rests in telescopes 5 in its bottom position. For fixing the reclining-surface frame on telescopes 5, locking screws (not shown in the drawing) are provided, being clamped tight in the slits by means of a counternut.

Reclining-surface frame 8 can encompass a reclining surface, e.g. a slatted base, integrated on it in one piece. In another embodiment, it can display retaining elements on which the reclining surface, e.g. a slatted base, is retained.

At the bottom end, telescopes 5 display means (not shown in the drawing) for attaching wheels. At least two of the wheels can be of lockable design.

FIGS. 3 and 4 show further, enlarged details X and Y from FIG. 1.

FIG. 5 shows an enlarged, horizontal cross-section at the level of circle "X" in FIG. 1. Telescopic sleeve 5.1 displays two integrated bulbs 5.3 and 5.5, arranged at right angles to each other, each of which displays an undercut slit 5.4 or 5.6, which is parallel to the axis and extends over the length of the sleeve. Like previously mentioned reclining-surface frame 8, both side elements 4 and also head and foot elements 2 and 3 are provided with anchoring elements 4.3 and 2.6 on the lateral, vertical face ends, these being inserted into slits 5.4 and 5.6, respectively. Following insertion of the anchoring elements of reclining-surface frame 8, and those of the end and side elements, the top side of the telescopic sleeve is covered with a snap-in cap 9 (FIG. 2, Detail A from FIG. 1).

The invention claimed is:

1. Lift bed, consisting of four, telescopic lifting columns, which can be connected by a reclining-surface frame, as well as by head, foot and side elements, where the lifting columns each display a slit, which is parallel to an axis and points towards an adjacent side element, and the reclining-surface frame and the side elements display corresponding anchoring elements that can be inserted into the slits in sliding fashion from above.

2. Lift bed according to claim 1, characterized in that the lifting columns are each provided with a slit, which is parallel to the axis and points towards an adjacent head or foot element, and the head and foot elements are provided with corresponding anchoring elements that can be inserted into the slits in sliding fashion from above.

3. Lift bed according to claim 1, characterized in that the slits display undercuts.

4. Lift bed according to claim 1, where the reclining-surface frame and the head, foot or side elements display locking means for non-positive or positive locking of the anchoring elements in the slits.

5. Lift bed according to claim 1, where the lifting columns are designed as spindle-type telescope, and an upper telescopic section forms an outer sleeve displaying the slit or slits.

6. Lift bed according to claim 5, where the upper telescopic section is designed as a continuously cast section with integrated bulbs that are parallel to the axis and accommodate the slits.

7. Lift bed according to claim 5, where the telescopic columns accommodating the head or foot element further comprise lower, inner sleeves that are connected via a bridge at the bottom end.

8. Lift bed according to claim 7, where the two spindle-type telescopes connected by the bridge are driven by a common electric motor, and power transmission from the motor to the spindles is accomplished via toothed belts, ladder chains or a shaft located within the bridge.

9. Lift bed according to claim 1, where plastic covers are provided for the slits accommodating the side elements, insofar as they are not covered by the side elements.

10. Lift bed according to claim 1, where the lifting columns are designed as threefold telescopes.

11. Double telescopic unit as a component for a lift bed according to claim 1, comprising two telescopic lifting columns, each of which displays a slit, which is parallel to an axis and points towards an adjacent side element, where the two telescopic columns are rigidly connected via a bridge at the bottom end, and means for attaching wheels.

12. Double telescopic unit according to claim 11, characterized in that an electric motor is located on or in the bridge, and power transmission from the electric motor to one or more spindles is accomplished via toothed belts, ladder chains or a shaft located within the bridge.

* * * * *

UNITED STATES PATENT AND TRADEMARK OFFICE

CERTIFICATE OF CORRECTION

PATENT NO. : 7,437,786 B2
APPLICATION NO. : 11/420105
DATED : October 21, 2008
INVENTOR(S) : Bellingroth It is certified that error appears in the above-identified patent and that said Letters Patent is hereby corrected as shown below:

On the Title Page, Item (30), under "Foreign Application Priority Data", line 1, delete "20 2005 008 326 U" and insert -- 20 2005 008 326.7 U --, therefor.

Signed and Sealed this

Second Day of June, 2009

JOHN DOLL
*Acting Director of the United States Patent and Trademark Office*